US011280481B1

(12) United States Patent
Yeats

(10) Patent No.: US 11,280,481 B1
(45) Date of Patent: Mar. 22, 2022

(54) LIGHTING APPARATUS

(71) Applicant: Minot Light Development Group, LLC, Marshfield, MA (US)

(72) Inventor: Ryan H. Yeats, Marshfield, MA (US)

(73) Assignee: MINOT LIGHT DEVELOPMENT GROUP, LLC, Marshfield, MA (US)

( * ) Notice: Subject to any disclaimer, the term of this patent is extended or adjusted under 35 U.S.C. 154(b) by 30 days.

(21) Appl. No.: 16/443,258

(22) Filed: Jun. 17, 2019

Related U.S. Application Data

(63) Continuation of application No. 16/441,997, filed on Jun. 14, 2019, now abandoned.

(60) Provisional application No. 62/686,768, filed on Jun. 19, 2018.

(51) Int. Cl.
*F21V 21/096* (2006.01)
*F21S 8/02* (2006.01)
*F21S 8/04* (2006.01)

(52) U.S. Cl.
CPC ..... *F21V 21/096* (2013.01); *F21S 8/026* (2013.01); *F21S 8/043* (2013.01)

(58) Field of Classification Search
CPC .... F21V 21/096; F21V 21/048; F21V 21/049; F21S 8/026; F21S 8/043; F21S 8/06
See application file for complete search history.

(56) References Cited

U.S. PATENT DOCUMENTS

| | | | | |
|---|---|---|---|---|
| 9,243,786 | B1 * | 1/2016 | Onda | F21V 21/041 |
| 10,234,091 | B1 * | 3/2019 | Chaimberg | F21V 17/162 |
| 2004/0042222 | A1 * | 3/2004 | Childs | F21V 21/03 362/432 |
| 2008/0112171 | A1 * | 5/2008 | Patti | F21V 21/04 362/365 |
| 2011/0285314 | A1 * | 11/2011 | Carney | F21V 29/70 315/294 |
| 2012/0194069 | A1 * | 8/2012 | Wang | F21V 19/003 315/32 |
| 2013/0176742 | A1 * | 7/2013 | Patti | F21V 21/04 362/365 |

* cited by examiner

*Primary Examiner* — Rajarshi Chakraborty
*Assistant Examiner* — Nathaniel J Lee
(74) *Attorney, Agent, or Firm* — Burns & Levinson, LLP; Joseph M. Maraia

(57) ABSTRACT

A system for providing temporary light includes a bracket that spans across an opening in a pre-installed recessed lighting fixture. An opening in the bracket receives a power cord from a power supply and is connected to a light engine. Another bracket includes a light engine to be placed across the pre-installed lighting fixture opening, where the light engine is powered by the power supply.

16 Claims, 13 Drawing Sheets

SIDE VIEW

BOTTOM VIEW

LIGHTING APPARATUS

RELATED APPLICATION

This application is a Continuation of U.S. application Ser. No. 16/441,997, filed Jun. 14, 2019, which claims priority to U.S. Provisional Application No. 62/686,768, filed Jun. 19, 2018 and entitled "LIGHTING APPARATUS," the entire contents of which are incorporated by reference herein for all purposes.

FIELD OF THE INVENTION

The disclosure relates to light fixtures.

BACKGROUND OF THE INVENTION

When working on a jobsite, whether it is for a residential, commercial or any other type of project, it is necessary to provide temporary lighting as the light fixtures generally are not installed until the ceiling is finished and, even once the ceiling is roughed-in, the lights are not completed till the end of the project so that they are not damaged during construction. Temporary stringer lights are often zip-tied to the exposed ceiling beams to provide illumination prior to ceiling installation. Once the installation of the ceiling is started, however, the stringer lights have to be removed. This results in a situation where there is no longer a light source.

In some instances, light stands may be provided for illumination. The light stands have disadvantages as they are costly, have to be removed daily to prevent theft, and take up floor space and, therefore, could be a safety risk. If they are in the way, then they have to be moved and they are heavy and awkward which could lead to injuring a worker. In addition, the illumination that they provide is usually directed up toward the ceiling because the light is otherwise in everyone's eyes. This reflected light may not be adequate.

What is needed is better temporary lighting in a construction area.

SUMMARY

In one aspect of the present disclosure is a system for providing temporary lighting comprising: a bracket configured to span a light opening in a pre-installed recessed lighting fixture, a bracket opening defined in the bracket and configured to receive a power cord from a pre-installed power supply, and a light source configured to couple to the power cord.

Another aspect of the present disclosure is a system for providing temporary lighting, comprising: a recessed lighting system including a power supply and a mounting support with an opening defined, a bracket with an opening defined, disposed across the mounting support opening such that the mounting support opening and the bracket opening intersect, and a light source coupled to the power cord, which is disposed through the mounting support opening and the bracket opening without covering the mounting support opening.

Another aspect of the present disclosure is a method of providing temporary lighting comprising: installing a power supply and mounting support with an opening defined, providing a bracket with an opening defined, across the mounting support opening such that the bracket opening interacts with the mounting support opening, providing a light source on the bracket such that light from the light source is directed through the mounting support opening and the bracket opening, and connecting the light source to the power supply.

BRIEF DESCRIPTION OF THE DRAWINGS

One or more aspects of the present disclosure are discussed below with reference to the accompanying Figures. It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. For purposes of clarity, however, not every component may be labeled in every drawing. The Figures are provided for the purposes of illustration and explanation and are not intended to be limiting. In the Figures.

DETAILED DESCRIPTION

Figure 1:
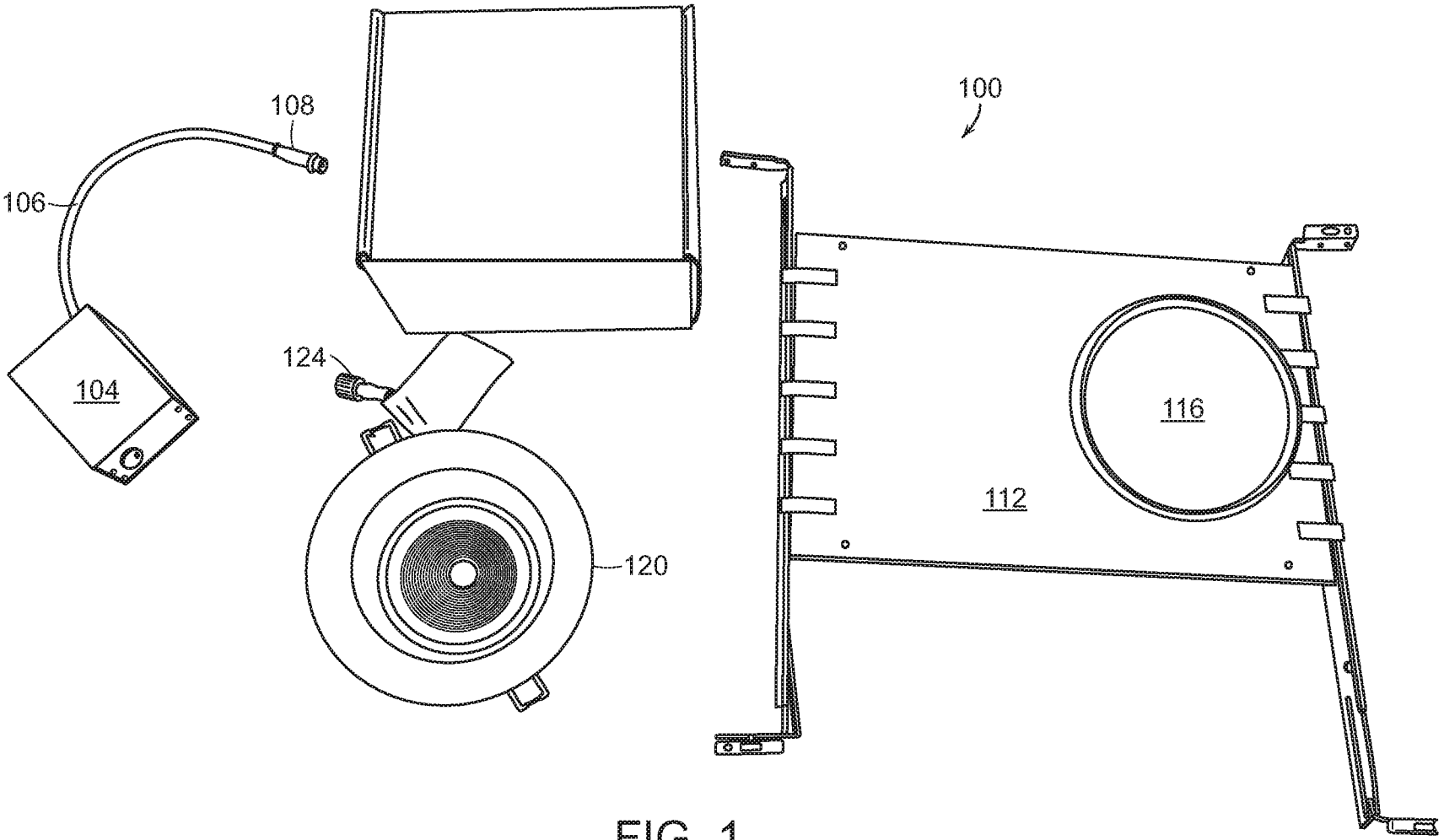
FIG. 1 is a known lighting system.

In the following detailed description, numerous specific details are set forth in order to provide a thorough understanding of the aspects and implementations of the present disclosure. It will be understood by those of ordinary skill in the art that these may be practiced without some of the specific details that are set forth. In some instances, well-known methods, procedures, components and structures may not have been described in detail so as not to obscure the details of the implementations of the present disclosure.

It is to be understood that the details of construction and the arrangement of the components set forth in the description or illustrated in the drawings are not limiting. There are other ways of being practiced or carried out. Also, it is to be understood that the phraseology and terminology employed herein are for the purpose of description only and also should not be regarded as limiting.

It is appreciated that certain features, which are, for clarity, described in the context of separate implementations, may also be provided in combination in a single implementation. Conversely, various features, which are, for brevity, described in the context of a single implementation, may also be provided separately or in any suitable sub-combination.

Generally, as will be described below in more detail, various aspects of the present disclosure provide for, among others, different approaches to providing a temporary lighting solution during the remainder of the rough-finish portion of projects or jobsites where recessed LED lighting systems are installed. More specifically, the temporary lighting is available after insulation, sheetrock and plaster have been installed. Advantageously, the temporary lighting can be used by, for example, finish carpenters, painters, or other trades, up until the last leg of construction—a period of time that could be around two months or more. Further, the temporary lighting solution could be implemented during rough electrical stages as well in order to provide for temporary lighting.

Figure 2:
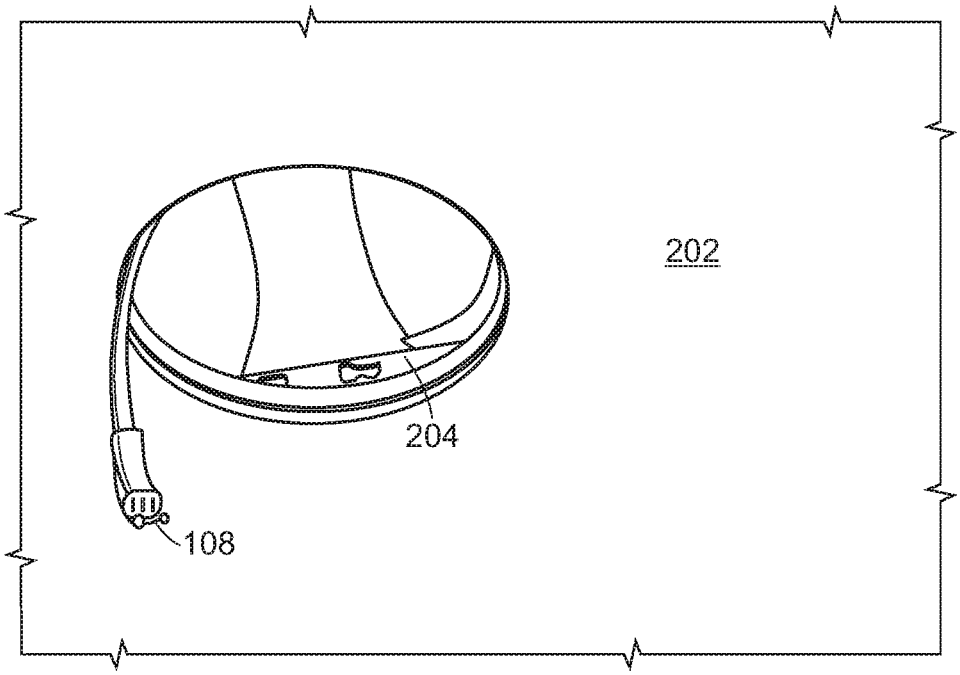
FIG. 2 is a roughed-in installation of the known lighting system of FIG. 1.

Referring now to FIG. 1, a known recessed LED lighting system 100 includes a power source 104, for example, an AC/DC converter, with a cord 106 and an output plug 108, a mounting support 112 with an opening 116 defined therein and a light fixture 120 with a connector 124. The mounting support 112 is mounted between the joists per known procedures and once a finished ceiling 202 is roughed-in, as shown in FIG. 2, the output plug 108 is available via an opening 204 in the ceiling 202.

Figure 3:
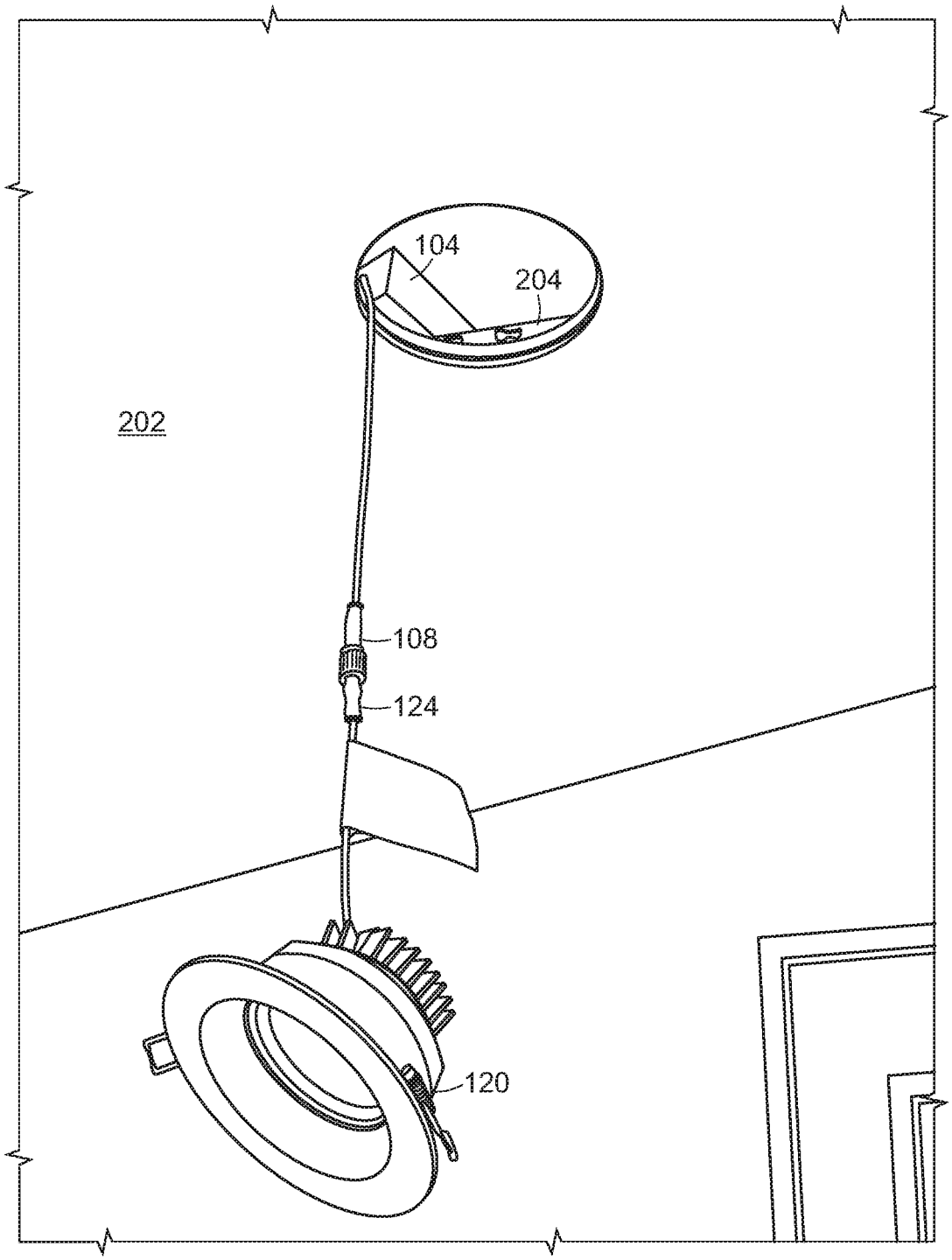
FIG. 3 is a representation of the known lighting system of FIG. 1 with a light fixture connected.
Figure 4:
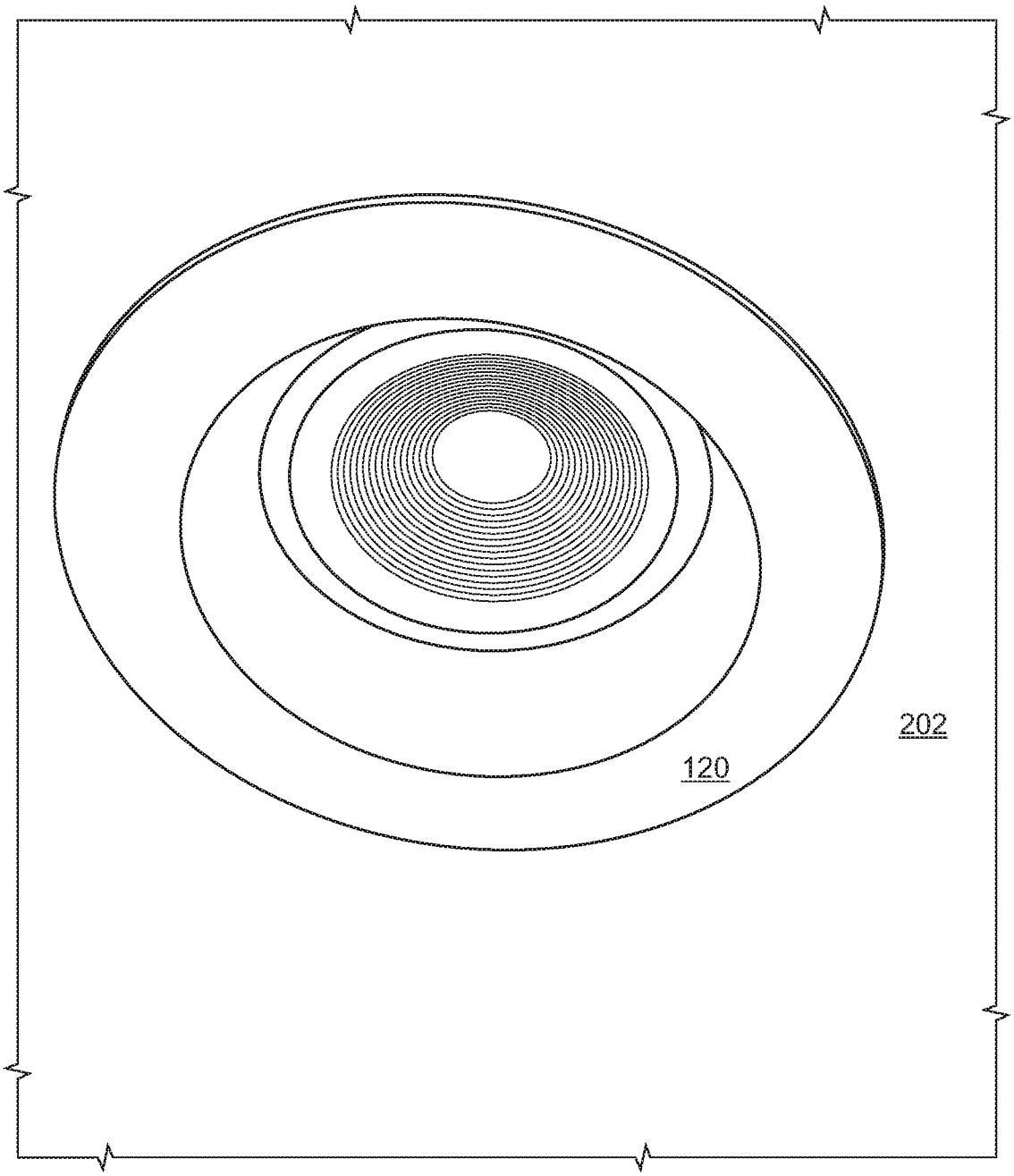
FIG. 4 is a representation of a finished installation of the known lighting system of FIG. 1.

The connector 124 is coupled to the output plug 108, as shown in FIG. 3, and then the light fixture 120 is inserted into the opening 116 and the opening 204 for final installation, as shown in FIG. 4.

The recessed LED lighting system 100, and those like it, are increasingly being implemented rather than the previously commonly installed recess cans and housings for incandescent bulbs. Accordingly, the basic 110 volt lightbulb that could once be used as a temporary light is now irrelevant as the power source 104 of the lighting system 100 transforms 110 volts AC to 12-40 volts DC to operate the LED in the light fixture 120.

As described above, once the ceiling is roughed in, alternate light sources are needed to adequately illuminate the work area. Of course, the light fixture 120 could be plugged in and left hanging as shown in FIG. 3. This is, however, not practical as the chances of damaging the light fixture 120 and/or hitting one's head are likely. In addition, the coupling of the connector 124 to the output plug 108 may not be strong enough to support the weight of the light fixture 120 and it could be damaged if it fell to the floor.

Figure 5A:
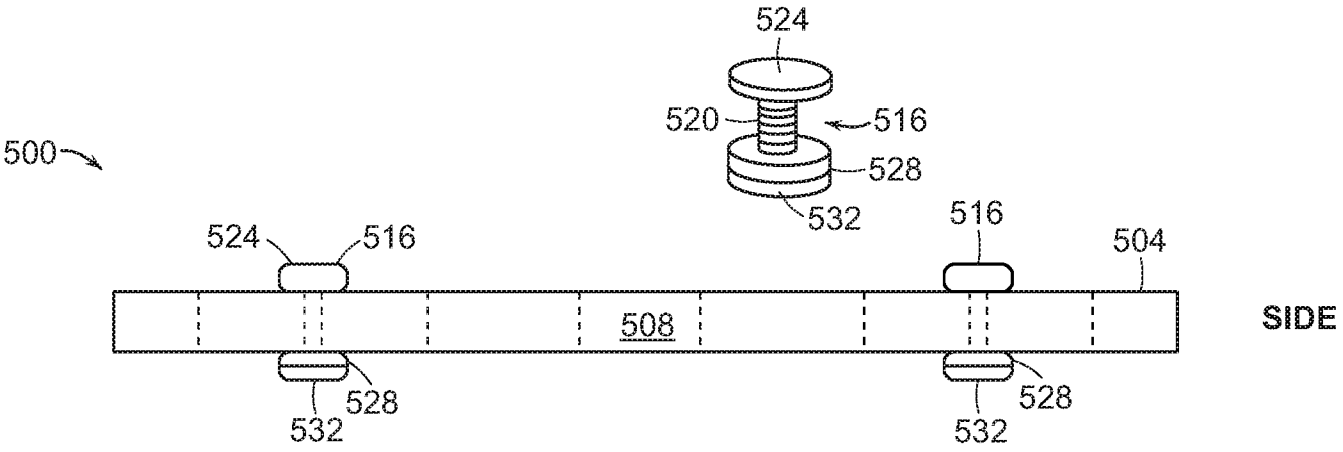
FIGS. 5(*a*) to 5(*c*) show top, side and perspective views, respectively, of a bracket in accordance with an aspect of the present disclosure.
Figure 5B:
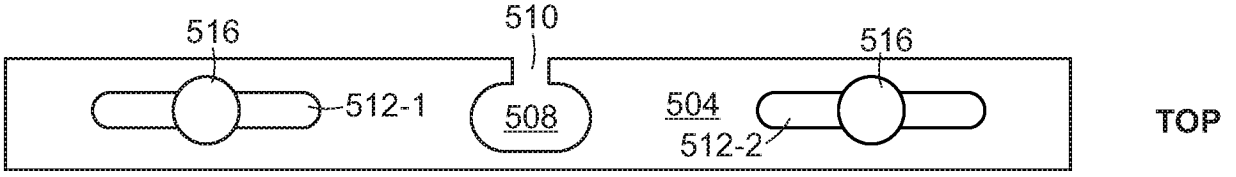
Figure 5C:
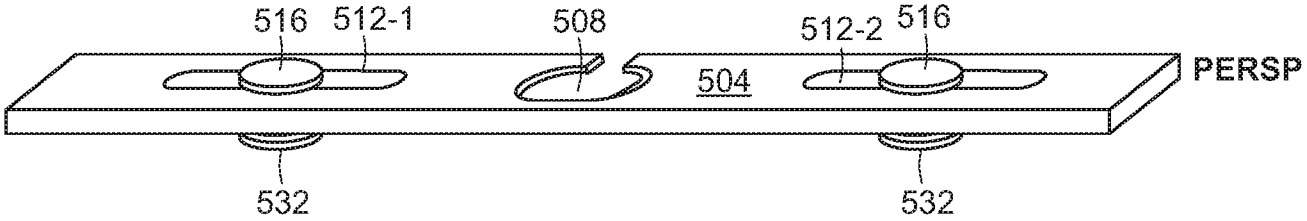

In one aspect of the present disclosure, a bracket 500, as shown in FIGS. 5(*a*) to 5(*c*), is provided in order to facilitate a light source from installed portions of the lighting system 100, as will be described below.

The bracket 500 includes a platform 504 that could be made from plastic, aluminum, metal, etc., in which a central opening 508 is defined. The central opening 508 may include a slot, notch, or cut 510, as shown, or could be a closed hole. Generally, the central opening 508, when implemented without a cut 510, is sized to allow a cord with a plug, as described below, to pass through. Two elongated openings or slots 512-1, 512-2 are also defined and run in a longitudinal direction of the platform 504. In some aspects, only one slot 512 may be provided. Each slot 512 has a button 516 slidably disposed in a respective slot 512.

The button 516 comprises a central shaft 520 positioned between a first cap 524 and a second cap 528. A magnet 532 is securely attached to the second cap 528. The central shaft 520, first cap 524 and second cap 528 may be made from a plastic. The button 516 is shaped and sized to slide within the slot 512. Accordingly, if the platform 504 is made from a material to which the magnet 532 is attracted, the second cap 528 is provided to allow for the button 516 to slide. If the platform 504 is made from non-ferrous material then the second cap 528 may not be necessary and the magnet 532 may be directed attached to the central shaft 520.

Figure 6:
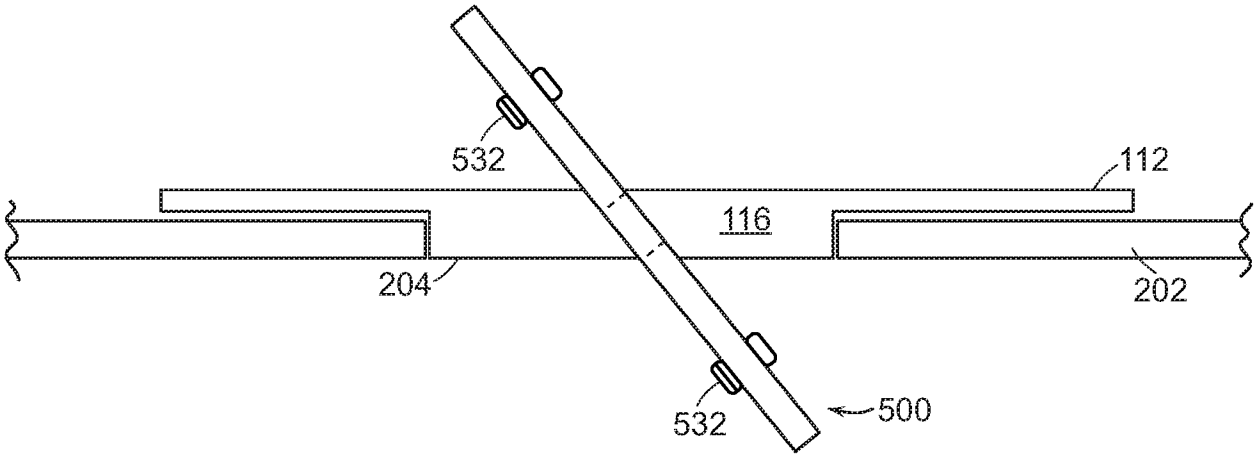
FIG. 6 is a representation of the installation of the bracket of FIG. 5 in accordance with an aspect of the present disclosure.
Figure 7A:
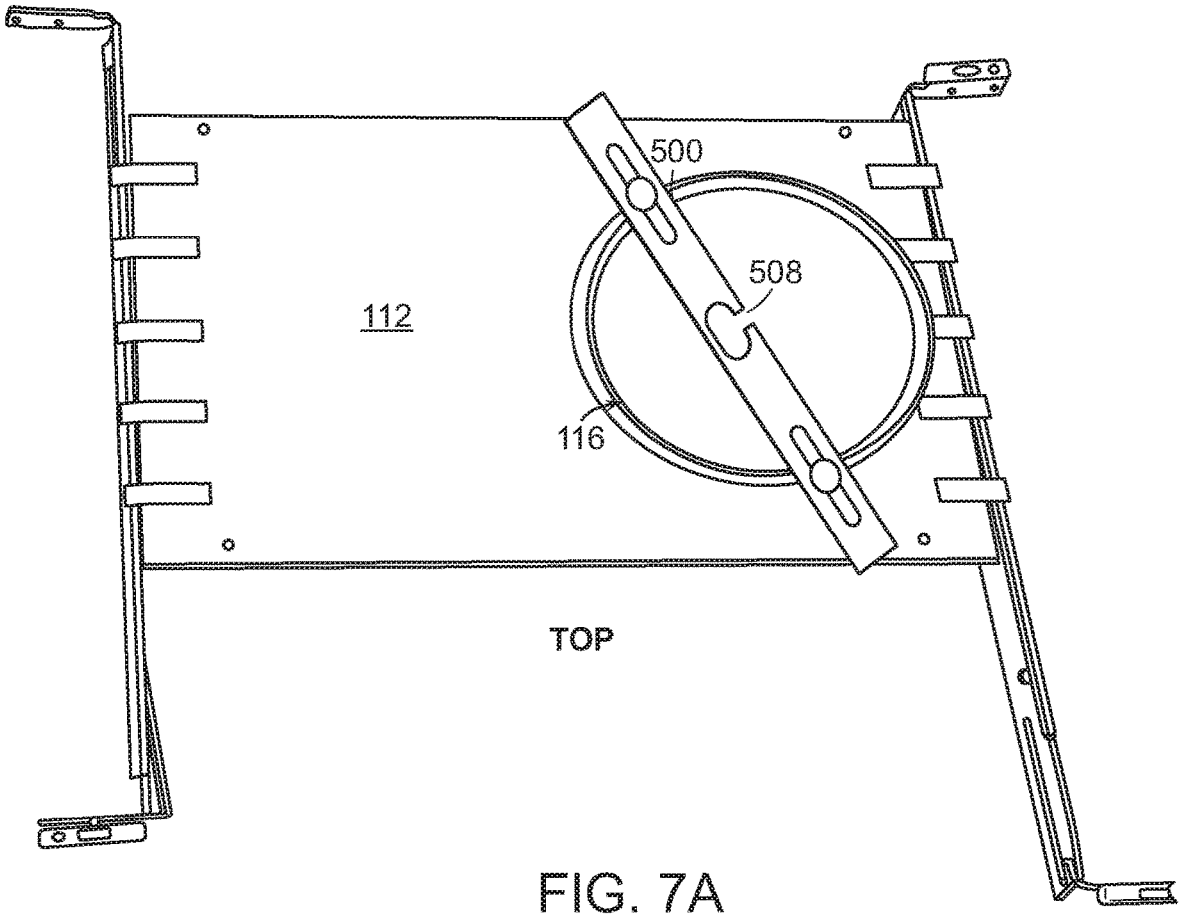
FIGS. 7(*a*) and 7(*b*) show top and side views, respectively, of the bracket of FIG. 5 positioned in accordance with an aspect of the present disclosure.
Figure 7B:
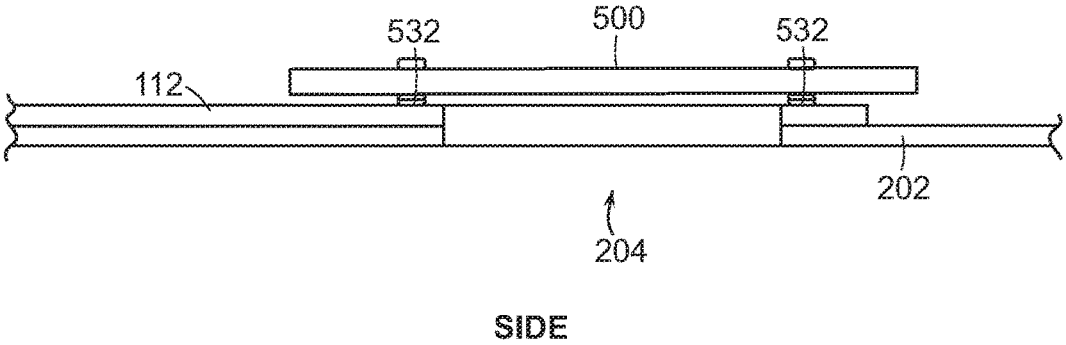

Referring now to FIG. 6, the bracket 500 is inserted up through the ceiling opening 204 and the opening 116 in the support 112. The support 112 is placed such that the opening 508 is visible in the opening 116, for example, centered in the opening 116, and the magnets 532 are coupled to the support 112. Each magnet 532 may be pre-positioned in its respective slot 512 to be located over a portion of the support 112. Generally, as is known in the industry, the support or can 112 is made of a material, such as sheet metal, to which the magnet 532 will adhere. The placement of the support 112 is shown from the top and side in FIGS. 7(*a*) and 7(*b*).

Figure 8:
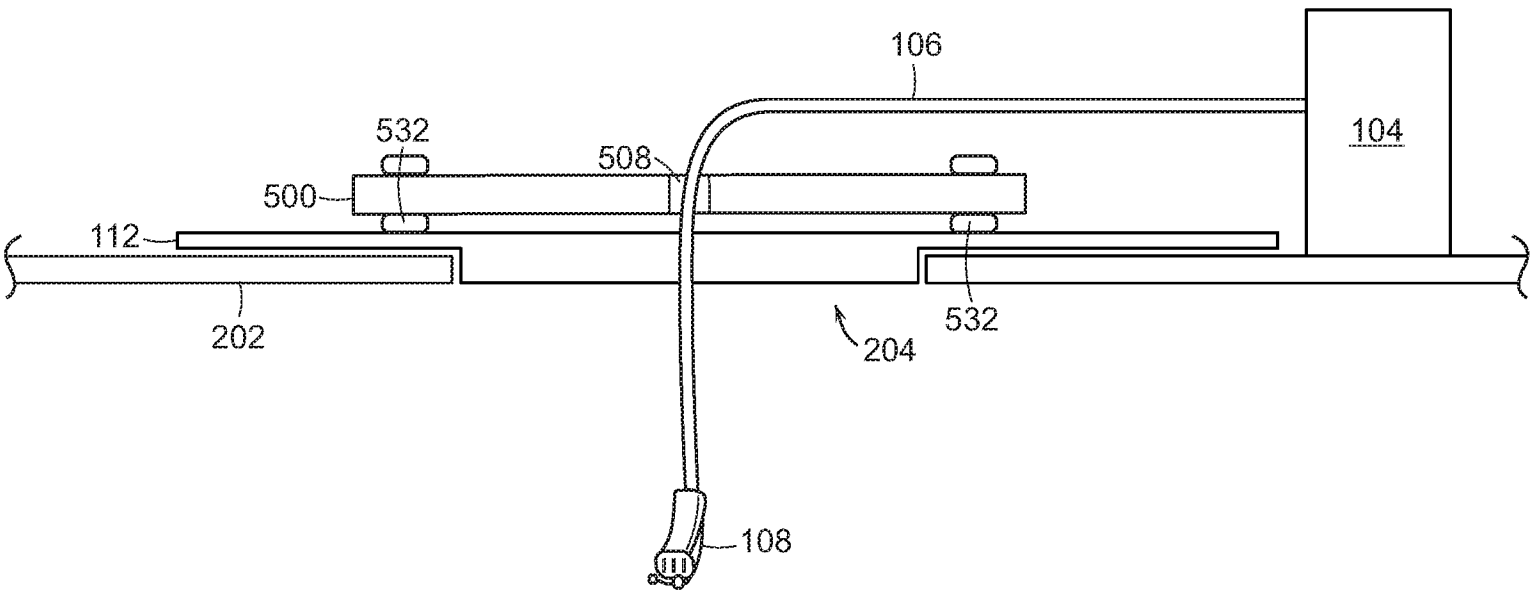
FIG. 8 shows an implementation of the bracket of FIG. 5 in accordance with an aspect of the present disclosure.
Figure 9D:
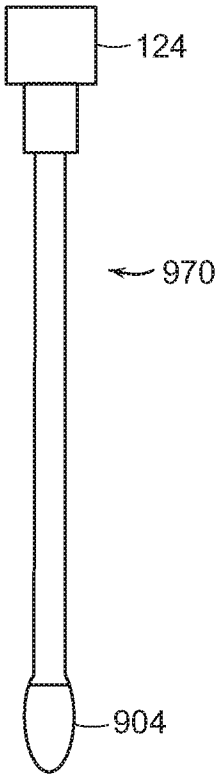
FIGS. 9(*a*) to 9(*d*) show a number of temporary lighting fixtures in accordance with aspects of the present disclosure.
Figure 9C:
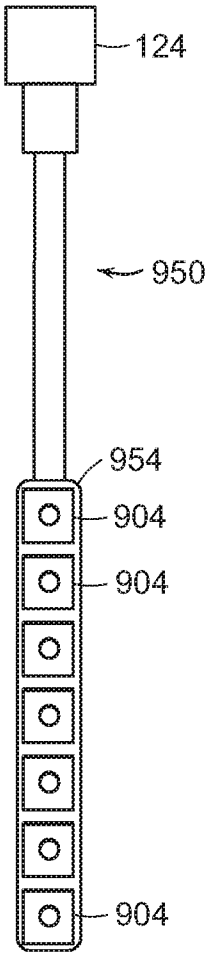
Figure 9B:
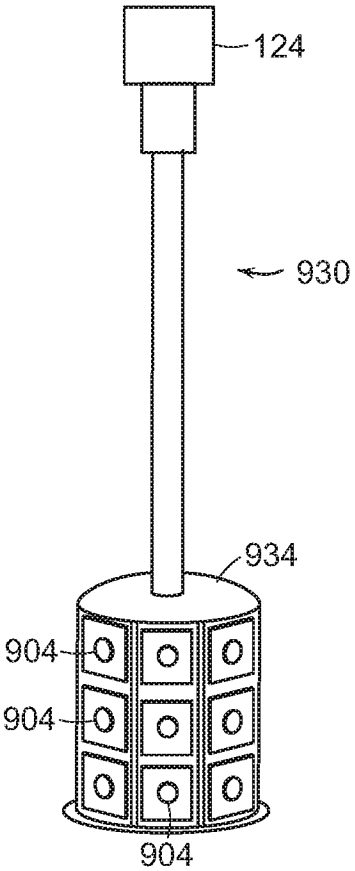
Figure 9A:
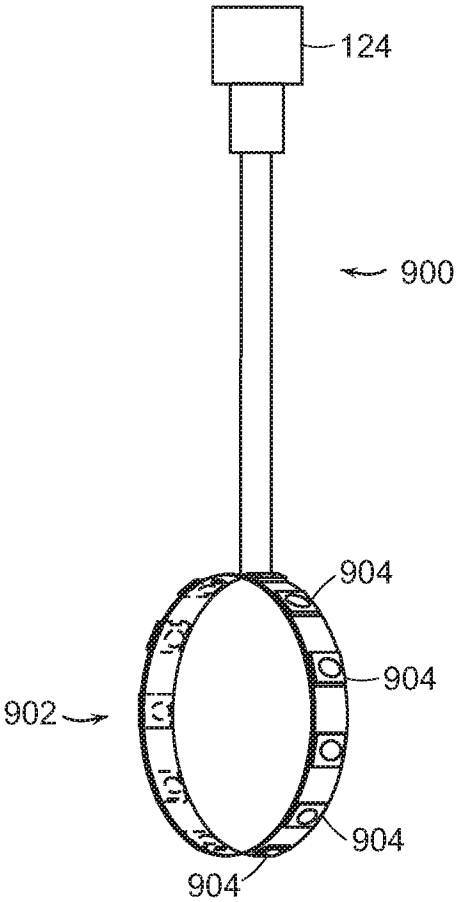

Once the bracket 500 is in place on the support 112, as shown in FIG. 8, the cord 106 is directed through the cut 508 such that the output plug 108 is accessible from below. The cord 106 is now positioned away from an edge of the support opening 116 to reduce the chance of rubbing and/or fraying of the cord.

Advantageously, in order to provide light in the work area, without installing the final light fixture 120, a temporary light fixture can be coupled to the output plug 108. The temporary light fixture may be a looped lighting device 900 including the connector 124 and a loop 902 having a plurality of LEDs 904 disposed thereon, as shown in FIG. 9(*a*). The LEDs 904 are powered by the power source 104. The temporary light fixture may have a translucent covering to further protect the LEDs 904 disposed therein.

The temporary light fixture may also be a cylindrical lighting device 930 that includes the connector 124 and a cylinder 934 having a plurality of LEDs 904 disposed thereon, as shown in FIG. 9(*b*). The LEDs 904 are also powered by the power source 104.

The temporary light fixture may also be a linear lighting device 950 that includes the connector 124 and a linear portion 954 having a plurality of LEDs 904 disposed thereon, as shown in FIG. 9(*c*). The LEDs 904 are also powered by the power source 104.

Another temporary light fixture may be a lighting device 970 that includes the connector 124 and a single LED 904, as shown in FIG. 9(*d*). The LED 904 is powered by the power source 104.

The LEDs 904 may be of a size or power level chosen to provide an amount of desired light in the work area. The LEDs 904 may be omnidirectional LEDs or any other type of LED as are known to those of ordinary skill in the art.

Once it is time for the light fixture 120 to be installed, the temporary light fixture is unplugged and the bracket 500 is removed. The magnets 532 facilitate the removal of the bracket 500. The fixture 120 can then be installed.

Figure 10A:
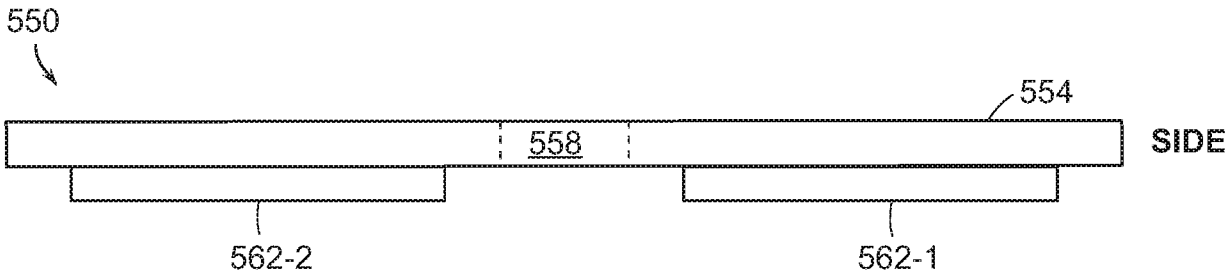
FIGS. 10(*a*) and 10(*b*) show top and bottom views, respectively, of another bracket in accordance with another aspect of the present disclosure.
Figure 10B:
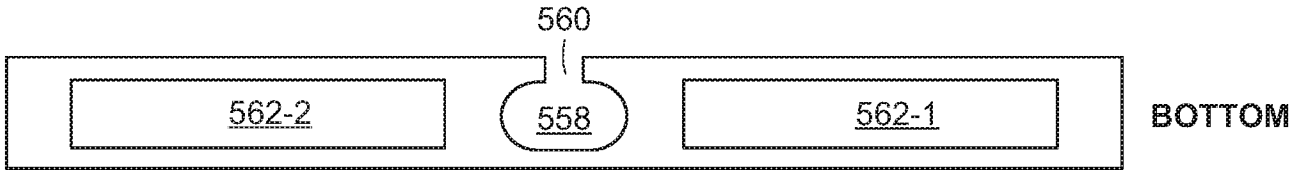

In another aspect of the present disclosure, referring now to FIGS. 10(*a*) and 10(*b*), a bracket 550 includes a platform 554 that could be made from plastic, aluminum, metal, etc., in which a central opening 558 is defined. The central opening 558 may include a slot, notch, or cut 560, as shown, or could be a closed hole. Generally, the central opening 558, when implemented without a cut 560, is sized to allow a cord with a plug, as described above, to pass through. Two elongated magnetic strips 562-1, 562-2 are provided on the platform 554 and run in a longitudinal direction of the platform 554. In some aspects, only one magnetic strip 562 may be provided. The magnetic strips 562 are sized and positioned to contact the mounting support 112 when the bracket 550 is spanned across the opening 116, similar to the implementation of the bracket 500 described above. The magnetic strips 562 are attached to the platform 554 in a manner sufficient to allow the removal of the bracket 550 from the mounting support 112, for example, by glue or other adhesive.

Further, the bracket 550 is positioned in a manner similar to the bracket 500 as was described above in FIGS. 6-8.

Figure 11:
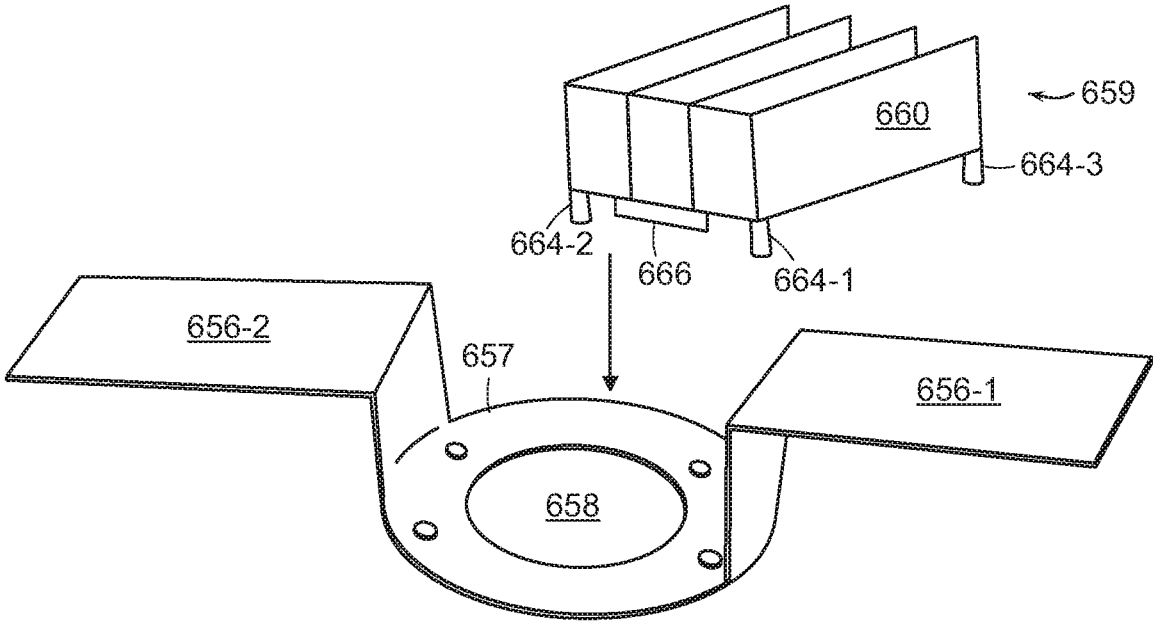
FIG. 11 shows another bracket in accordance with another aspect of the present disclosure.

In another aspect of the present disclosure, referring now to FIG. 11, a bracket 650 includes a platform 654 that could be made from plastic, aluminum, metal, etc. The platform 654 includes a central opening 658 in a U-shaped portion 657 between the flanges 656-1 and 656-2. A light engine 659 is configured to fit in the U-shaped portion 657. The light engine comprises a heat sink 660 for heat dissipation, an LED light source 666 coupled to the heat sink 660, and 4 screws, 664-1, 664-2, 664-3, and 664-4, to secure the heat sink 660 to the U-shaped portion 657.

Figure 12A:
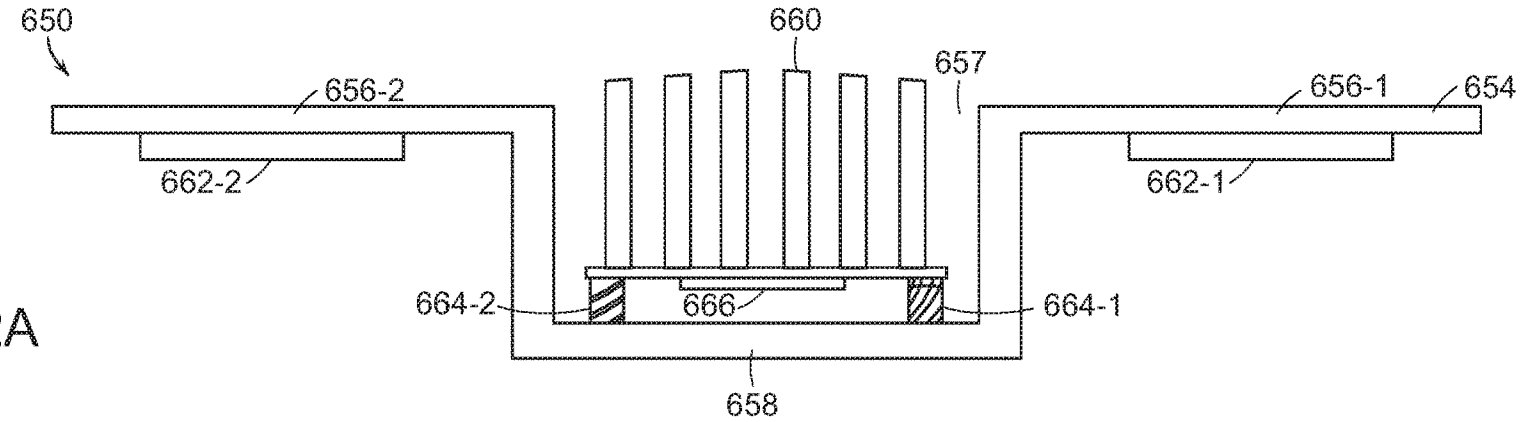
FIGS. 12(*a*) and 12(*b*) show side and bottom views, respectively, of FIG. 11 in accordance with an aspect of the present disclosure.
Figure 12B:
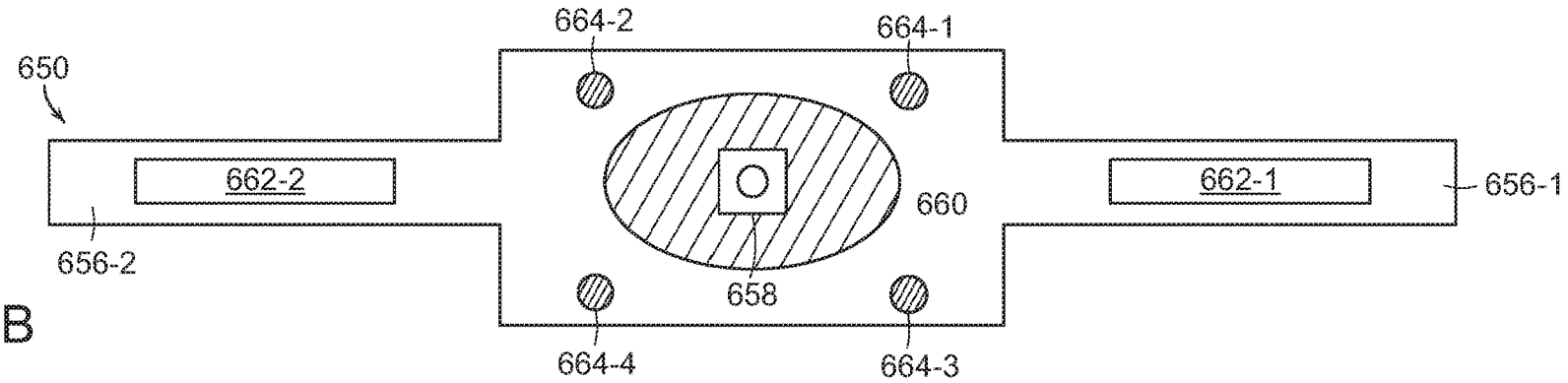

Referring to FIG. 12, magnetic strips 662-1 and 662-2 can be provided on the platform 654 and run in a longitudinal direction of the platform 654. In some aspects, only one magnetic strip 662 may be provided. The magnetic strips 662 are sized and positioned to contact the mounting support 112 when the bracket 650 is spanned across the opening 116, similar to the implementation of the bracket 500 described above. The magnetic strips 662 are attached to the platform 654 in a manner sufficient to allow the removal of the bracket 650 from the mounting support 112, for example, by glue or other adhesive. In some aspects of the present disclosure, the LED light source 666 is directly coupled to the heat sink 660 and positioned over the bracket opening 658, the bracket 650 is positioned in the opening 116, in a manner similar to the bracket 500 as was described above in FIGS. 6-8.

Figure 13:
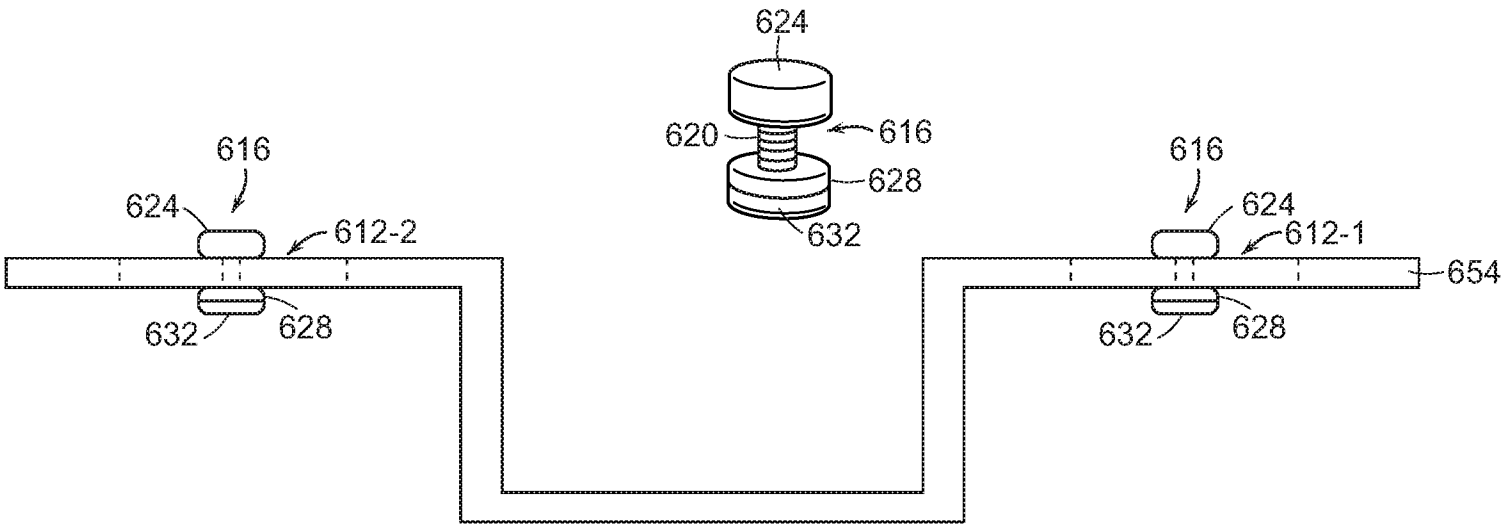
FIG. 13 shows an implementation of the bracket of FIG. 12 in accordance with an aspect of the present disclosure.

In another aspect of the present disclosure, referring now to FIG. 13, two elongated openings or slots 612-1, 612-2 are also defined and run in a longitudinal direction of the platform 654. While two are shown, only one slot 612 need be provided. Each slot 612 has a button 616 slidably disposed in a respective slot 612. The button 616 comprises a central shaft 620 positioned between a first cap 624 and a second cap 628. A magnet 632 is securely attached to the second cap 628. The central shaft 620, first cap 624 and second cap 628 may be made from a plastic. The button 616 is shaped and sized to slide within the slot 612. Accordingly, if the platform 654 is made from a material to which the magnet 632 is attracted, the second cap 628 is provided to allow for the button 616 to slide. If the platform 654 is made from non-ferrous material then the second cap 628 may not be necessary and the magnet 632 may be directed attached to the central shaft 620.

It is important to note that the light fixture 120 is a finished component and it is critical not to subject it to conditions in which it might become damaged. Advantageously, as described above, aspects of the present disclosure protect the light fixture 120 from damage as it is not installed until the finishing work is completed. As a temporary lighting solution is described herein, the light fixture 120 may remain protected in its original packaging up until the moment it is needed for final installation.

Further, an example of a ceiling mounted fixture is referenced above. It should be noted, however, that aspects of the present disclosure are not limited to just ceiling mounted lights and could be implemented in, for example, vertical lighting approaches.

While various aspects have been described, it will be apparent to those of ordinary skill in the art that many more embodiments and implementations are possible and are within the scope of this disclosure.

What is claimed is:

1. A system for providing temporary lighting, comprising:

a bracket defining a bracket opening, the bracket opening overlapping a mounting support opening in a pre-installed recessed light fixture in a ceiling, the recessed lighting fixture comprising a power supply and a mounting support, wherein the mounting support includes a first surface and a second surface, the first surface facing an interior surface of the ceiling and the second surface opposing the first surface; and a light source configured to couple to the power supply through the bracket opening, wherein the bracket is non-fixedly disposed on top of the second surface of the mounting support such that the light source hangs through the mounting support opening and below the ceiling.

2. The system of claim 1, wherein the bracket includes a platform made from plastic, aluminum, or metal.

3. The system of claim 1, wherein the bracket opening defined in the bracket comprises a slot, notch, cut, or a closed hole.

4. The system of claim 1, wherein the light source comprises a light-emitting diode and a heat sink.

5. The system of claim 1, further comprising:

at least one magnet disposed on the bracket to magnetically couple the bracket to the mounting support.

6. The system of claim 5, further comprising:

a slot defined in the bracket, where the at least one magnet is slidably disposed in the bracket slot.

7. The system of claim 5, wherein the at least one magnet is adhesively attached to the bracket.

8. A system for providing temporary lighting in an pre-installed recessed light fixture in a ceiling, the light fixture comprising a power source and a mounting support, wherein the mounting support includes a first surface and a second surface, wherein the first surface faces an interior surface of the ceiling and the second surface opposes the first surface, the recessed lighting mounting support having a mounting support opening defined therein, the temporary lighting system comprising:

a light engine comprising a bracket defining a bracket opening, a heat sink, and a light source, the heat sink and the light source coupled to the bracket, the light engine non-fixedly disposed on top of the second surface of mounting support such that the bracket overlaps the mounting support opening, wherein the bracket further comprises:

first and second flanges; and a central portion disposed between the first and second flanges, wherein the bracket opening is defined in the central portion, and wherein the light engine is provided on the central portion;

wherein the first and second flanges are coplanar with one another in a first plane and the central portion is in a second plane different from the first plane;

wherein the bracket is configured in a U-shape, wherein the central portion extends through the mounting support opening when the bracket is disposed across the mounting support opening;

wherein the light source is positioned near a center of the mounting support opening to transmit light below the mounting support opening, and the light engine is coupled to the power supply.

9. The system of claim 8, further comprising:

at least one magnet disposed on the bracket to magnetically couple the bracket to the mounting support.

10. The system of claim 9, further comprising:

a slot defined in the bracket, where the at least one magnet is slidably disposed in the bracket slot.

11. The system of claim 9, wherein the at least one magnet is adhesively attached to the bracket.

12. The system of claim 8, wherein the light source is at least one of: an incandescent light bulb or a light-emitting diode.

13. The system of claim 8, wherein the light source is positioned on top of the bracket to enable light to shine through the bracket opening.

14. A method of providing temporary lighting in a pre-installed recessed light fixture comprising a power supply and a mounting support, the recessed lighting mounting support comprising a mounting support opening defined therein, the method comprising:

non-fixedly disposing a light engine comprising:

a heat sink;

a light source coupled to the heat sink; and a U-shaped bracket comprising first and second flanges that are coplanar with one another in a first plane, and a central portion, disposed between the first and second flanges, in a second plane different from the first plane, the central portion defining a bracket opening, wherein the light engine is provided on the central portion, the bracket non-fixedly disposed on top of a second surface of a mounting support of a pre-installed recessed light fixture such that light from the light source is transmitted through the bracket opening and below a mounting support opening, the bracket overlapping the mounting support opening, wherein the mounting support includes a first surface and the second surface, wherein the first surface faces an interior surface of a ceiling and the second surface opposes the first surface, wherein the central portion extends through the mounting support opening when the bracket is disposed across the mounting support opening; and coupling the light engine to the power supply.

15. The system of claim 14, wherein the light source is positioned on top of the bracket to enable light to shine through the bracket opening.

16. A light engine, comprising:

a heat sink;

a light source coupled to the heat sink; and a U-shaped bracket comprising first and second flanges that are coplanar with one another in a first plane, and a central portion, disposed between the first and second flanges, in a second plane different from the first plane, the central portion defining a bracket opening, wherein the light engine is provided on the central portion, the bracket non-fixedly disposed on top of a second surface of a mounting support of a pre-installed recessed light fixture such that light from the light source is transmitted through the bracket opening and below a mounting support opening, the bracket overlapping the mounting support opening, wherein the mounting support includes a first surface and the second surface, wherein the first surface faces an interior surface of a ceiling and the second surface opposes the first surface, wherein the central portion extends through the mounting support opening when the bracket is disposed across the mounting support opening.

* * * * *